United States Patent [19]

Lu et al.

[11] 4,324,851

[45] Apr. 13, 1982

[54] POSITIVE COLOR TONERS

[75] Inventors: Chin H. Lu, Webster; Dominic F. Sherony, Fairport; Peter F. Erhardt, Webster, all of N.Y.

[73] Assignee: Xerox Corporation, Stamford, Conn.

[21] Appl. No.: 105,836

[22] Filed: Dec. 20, 1979

[51] Int. Cl.[3] ..... G03G 9/10

[52] U.S. Cl. ..... 430/106; 430/107; 430/110

[58] Field of Search ..... 430/106, 107, 110, 109, 430/527, 528, 108

[56] References Cited

U.S. PATENT DOCUMENTS

| | | | |
|---|---|---|---|
| 3,779,773 | 12/1973 | Inayama et al. | 430/527 |
| 3,804,619 | 4/1974 | Mammino et al. | 430/124 X |
| 3,893,935 | 7/1975 | Jadwin et al. | 430/110 |
| 3,909,259 | 9/1975 | Mammino et al. | 430/107 |
| 3,970,571 | 7/1976 | Olson et al. | 430/110 |
| 3,985,664 | 10/1976 | Sakaguchi et al. | 430/110 |
| 4,066,563 | 1/1978 | Mammino et al. | 430/108 |
| 4,146,494 | 3/1979 | Hectors et al. | 430/107 |

FOREIGN PATENT DOCUMENTS

| | | |
|---|---|---|
| 1181287 | 2/1970 | United Kingdom . |
| 1536514 | 12/1978 | United Kingdom . |

*Primary Examiner*—Richard L. Schilling
*Assistant Examiner*—John L. Goodrow
*Attorney, Agent, or Firm*—E. O. Palazzo

[57] ABSTRACT

This invention is generally directed to a positively charged dry colored developer containing a resin, colored pigments, a single common carrier, and an alkyl pyridinium compound or the corresponding hydrate of the formula:

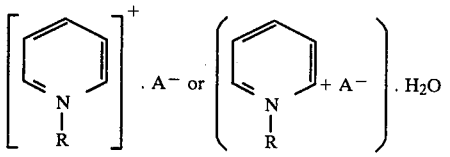

wherein R is a hydrocarbon radical containing from about 8 to about 22 carbon atoms, and A is an anion, which in a preferred embodiment is selected from halides, sulfate, sulfonate, nitrate, borate, and phosphate. Examples of the colored pigments include magenta materials such as 2,9-dimethyl substituted quinacridones, while examples of cyan materials include copper tetra-4-(octadecylsulfonomido) phthalocyanines, and examples of yellow pigments include permanent yellow FGL, Color Index pigment yellow 97 and diaryldide yellow 3,3-dichloro benzidene, aceto anilides. The preferred resin is a styrene/n-butylmethacrylate resin while the preferred carrier used in the developer composition is a steel coated carrier, wherein the coating is comprised of a polyvinylidene fluoride resin. This developer composition was found to be useful in developing colored images in a xerographic fixture, wherein the photoreceptor contained in such system is charged negatively.

6 Claims, No Drawings

POSITIVE COLOR TONERS

BACKGROUND OF THE INVENTION

This invention is generally directed to new colored toners, and more specifically positively charged colored developer compositions, wherein a single common carrier is employed, which developers are useful for obtaining images of different colors.

The formation and development of images in an electrophotographic system, and more specifically a xerographic system is well-known as described, for example, in U.S. Pat. No. 2,297,691. In such systems, several methods are used for applying the electroscopic particles or toner to the latent electrostatic image to be developed, such methods including cascade development, U.S. Pat. No. 2,618,552; magnetic brush development, U.S. Pat. No. 2,874,063; powder cloud development, U.S. Pat. No. 2,221,776; touchdown development, U.S. Pat. No. 3,166,432 and the like. Generally, the toners used in these types of systems result in the production of black images.

Recently there has been developed processes and materials for use in the formation of color images. Electrophotograhic color systems are generally based on trichromatic color synthesis, such as the substractive color formation types. Accordingly, in electrophotographic color systems, toner or developing particles of at least three different colors are employed to synthesize a desired color. Generally, at least three color separation images are formed and the combined images register with each other to form a colored reproduction of a full colored original. In color xerography as described, for example, in Dessauer U.S. Pat. No. 2,972,374, at least three latent electrostatic images are formed by exposing a xerographic plate to different optical color separation images. Each of the latent electrostatic images is developed with a different color toner and subsequently the three toner images are combined to form the final full color image. This combination of three color toner images is generally made on a copy sheet such as paper to which the toner images are permanently affixed. One of the most common techniques for fixing these toner images to the paper copy sheet is by employing a resin toner which includes a colorant, and heat fixing the toner images to this copy sheet. Images may also be fixed by other techniques such as, for example, subjecting them to a solvent vapor.

In one known process an electrostatic latent image is exposed through a green filter to an imagewise projection of a color image to form an electrostatic latent image on the photoreceptor. This electrostatic latent image is then developed with the complimentary magenta color toner to form a magenta colored image corresponding to said electrostatic latent image, and transferred in register to an image receiving member. The photoreceptor is then electrostatically charged uniformly in the dark and exposed through a red filter to an imagewise projection of a color image in register with said magenta developed image to form a second electrostatic latent image, which second image is developed with the complimentary cyan color toner and likewise transferred in register. The photoconductor is again electrostatically uniformly charged in the dark and then exposed through a blue filter to an imagewise projection of a color image in register with said magenta and cyan developed images to form a third electrostatic latent image which is then developed with the complimentary yellow toner and again transferred in register. The sequence of exposures through colored filters in this multiple development process may be performed in any suitable sequence other than the green, red and blue mentioned.

In these systems one important aspect resides in registration of the color toner image on the copy sheet, that is, the cyan, magenta, and yellow image should be in registration on the receiving member.

Generally, each developer used comprises a toner or resin color mixture in combination with different carriers. The toners used must posesss the appropriate color and continue to function under machine conditions which expose the developer to impaction and humidity among other undesirable factors. A three color system that has been well known and used in the past includes pigments of suitable cyan, magenta and yellow materials. Other disadvantages of the prior art processes include the requirements that, (1) the photoreceptor be panchromatic, (2) the development response of each of the three toner developers be constant with usage, (3) the transfer of the three different developed images be constant, and (4) the use of more than one different carrier material.

Also it is known in the prior art that three color layers can be coated one on top of the other, the first layer being the magenta layer, the second being the cyan layer and the third being the yellow layer. Each substractive color transmits two thirds of the spectrum and absorbs one third. The combination of cyan, magenta and yellow layers appears black, while the combination of magenta and yellow layers appears red, the combination of magenta and cyan layers appears blue, and the combination of yellow and cyan layers appears green.

More importantly in the prior art the colored toners must be combined with different carriers in order to obtain satisfactory images, such toners generally being negatively charged with respect to the carriers. For example, in one prior art process, the magenta toner is combined with an uncoated nickel berry carrier, the cyan toner is combined with a methyl terpolymer coated steel shot carrier, and the yellow toner is combined with an uncoated nickel berry carrier. Thus in such a system, at least two different carriers must be employed for the purpose of adjusting the triboelectric charges. Copying systems employing such developers require complex design elements and further make the system rather sensitive to outside influences because of the presence of two or three carriers and the charging relationship between the carriers and toner. In such systems, it is necessary to obtain approximately the same charge level and the same charge sign, on each toner, thus a unique carrier must be formulated for each toner. Also, the negative color developers are humidity sensitive, that is, they display high triboelectric charges at low relative humidity, and low triboelectric charges at high relative humidity. Thus, the development responses are not constant. Furthermore, each negative color developer has its own humidity-sensitivity since for example, the uncoated nickel berry carrier is more humidity-sensitive than the methyl terpolymer coated steel shot carrier. Additionally the negatively charged color toners are unsatisfactory for causing the development of images in a positively charged system, that is, where the photoreceptor, such as an organic photoreceptor is charged negatively.

SUMMARY OF THE INVENTION

It is therefore an object of this invention to provide a dry positively charged electrophotographic color toner which overcomes the abovenoted disadvantages.

Another object of the present invention is to provide positively charged developer compositions which produce high quality color images.

Another object of the present invention is the provision of developers containing a single carrier, which developers are positively charged, and can be used for the production of colored images of high quality.

Yet another object of the present invention is the provision of positively charged color developer compositions that are not sensitive to humidity.

These and other objects of the present invention are accomplished by providing positively charged dry color developers comprising a resin, colored pigments, a single common carrier, and an alkyl pyridinium compound or its corresponding hydrate of the formula:

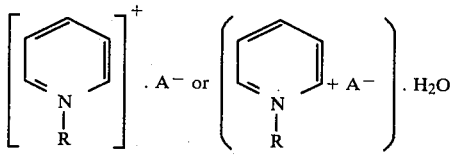

wherein R is a hydrocarbon radical containing from about 8 to about 22 carbon atoms, and preferably from about 12 to about 18 carbon atoms, and A is an anion, which in a preferred embodiment is selected from halides such as fluoride, chloride, bromide or iodide; sulfate, sulfonate, nitrate, borate and phosphate.

Illustrative examples of various hydrocarbon radicals include octyl, nonyl, decyl, myristyl, cetyl, olely, pentadecyl, haptadecyl, octadecyl, and the like. Specific illustrative examples of alkyl pyridinium compounds useful in the present invention include cetyl pyridinium chloride, heptadecyl pyridinium bromide, heptadecyl pyridinium chloride, myristyl pyridinium chloride, and the like, with cetyl pyridinium chloride being preferred.

The alkyl pyridinium compound can be used in any amount that does not adversely affect the system, and that results in a toner; the toner being comprised of resin, colored pigment, and an alkyl pyridinium compound or its hydrate, which toner is charged positively, in comparison to the carrier. Thus, for example, the amount of alkyl pyridinium compound present ranges from about 0.1 weight percent to about 10 weight percent, and preferably from about 1 weight to about 5 weight percent of the total toner weight. The alkyl pyridinium compound can either be blended into the system, or coated on the color pigments used in the developing composition.

Numerous different colored pigments can be used in the present invention including but not limited to magenta, cyan, and yellow pigments.

Illustrative examples of magenta materials which may be used in the present invention include 2,9-dimethyl substituted quinacridone, an anthraquinone dye identified in the Color Index as CI 60710, CI Dispersed Red 15, a diazo dye identified in the Color Index as CI 26050, CI Solvent Red 19, and the like.

Illustrative examples of cyan materials that may be used in the present invention include copper tetra-4-(octadecylsulfonomido)phthalocyanine, an X-copper phthalocyanine pigment listed in the Color Index as CI 74160, CI Pigment Blue 15, an indanthrene blue identified in the Color Index as CI 69810, Special Blue X-2137, and the like.

Illustrative examples of yellow materials that may be used in the present invention include permanent yellow FGL, Color Index Pigment Yellow 97, one of the preferred yellow materials which is prepared commercially by diazotization of 2,5-dimethoxy-aniline-4-sulfonanilide, followed by coupling with 4'-chloro-2',5'-dimethoxy-acetanilide, diarylide yellow 3,3-dichlorobenzidene aceto-acetanilide, a monoazo dye identified in the Color Index as CI 12700, CI Solvent Yellow 16, a nitrophenylaminesulfonamide identified in the Color Index as Foron Yellow Se-GLF, CI Dispersed Yellow 33, and the like.

The colored pigments are present in a range of from about 2 percent to about 20 percent, and preferably from about 5 percent to about 10 percent, by weight of the toner. In one specific preferred embodiment of the present invention the colored pigment such as cyan, magenta or yellow is present in an amount of 5 percent by weight of the toner.

While any suitable resin may be employed in the present invention, typical of such resins are polyamides, epoxies, polyurethanes, vinyl resins and polyesters especially those prepared from dicarboxylic acids and diols comprising diphenols. Any suitable vinyl resin may be employed in the toners of the present system including homopolymers or copolymers of two or more vinyl monomers. Typical of such vinyl monomeric units include: styrene, p-chlorostyrene, vinylnaphthalene, ethylenically unsaturated monolefins such as ethylene, propylene, butylene, isobutylene and the like; vinyl halides such as vinyl chloride, vinyl bromide, vinyl fluoride, vinyl esters such as vinyl acetate, vinyl propionate, vinyl benzoate, vinyl butyrate and the like; esters of alphamethylene aliphatic monocarboxylic acids such as methylmethacrylate, ethyl acrylate, n-butylacrylate, isobutyl acrylate, dodecyl acrylate, n-octyl acrylate, 2-chloroethyl acrylate, phenyl acrylate, methyl-alpha-chloroacrylate, methyl methacrylate, ethyl methacrylate, butyl methacrylate and the like; acrylonitrile, methacrylonitrile, acrylamide, vinyl ethers such as vinyl methyl ether, vinyl isobutyl ether, vinyl ethyl ether, and the like; vinyl ketones such as vinyl methyl ketone, vinyl hexyl ketone, methyl isopropenyl ketone and the like; vinylidene halides such as vinylidene chloride, vinylidene chlorofluoride and the like; and N-vinyl indoles, N-vinyl pyrrolidene and the like; and mixtures thereof.

Generally toner resins containing a relatively high percentage of styrene are preferred. The styrene resin employed may be a homopolymer of styrene or styrene homologs of copolymers of styrene with other monomeric groups. Any of the above typical monomeric units may be copolymerized with styrene by addition polymerization. Styrene resins may also be formed by the polymerization of mixtures of two or more unsaturated monomeric materials with a styrene monomer. The additional polymerization technique employed embraces known polymerization techniques such as free radical, anionic and cationic polymerization processes. Any of these vinyl resins may be blended with one or more resins if desired, preferably other vinyl resins which insure good triboelectric properties and uniform resistance against physical degradation. However, non-vinyl type thermoplastic resins may also be employed including resin modified phenolformaldehyde resins, oil modified epoxy resins, polyurethane resins, cellulosic resins, polyether resins and mixtures thereof.

Optimum electrophotographic resins are achieved with styrene butylmethacrylate copolymers, styrene vinyl toluene copolymers, styrene acrylate copolymers, polyester resins, predominantly styrene or polystyrene base resins as generally described in U.S. Pat. No. 25,136 to Carlson, polystyrene blends as described in U.S. Pat. No. 2,788,288 to Rheinfrank and Jones, and styrene-butadiene resins.

Also esterification products of a dicarboxylic acid an a diol comprising a diphenol may be used as a preferred resin material for the toner composition of the present invention. These materials are illustrated in U.S. Pat. No. 3,655,374, totally incorporated herein by reference, the diphenol reactant being of the formula as shown in Column 4, beginning at line 5 of this patent and the dicarboxylic acid being of the formula as shown in column 6 of the above patent.

The resin is present in an amount so that all toner composition ingredients total about 100 percent, thus when 5 percent by weight of the alkyl pyridinium compound is used and 10 percent by weight of pigment such as magenta is present, about 85 percent by weight of the resin material is used.

Any single carrier material can be employed, as long as such material is capable of triboelectrically obtaining a charge of opposite polarity to that of the toner particles. In the present invention, that would be a negative polarity, thus the toner particles which are positively charged will adhere to and surround the carrier particles. The carriers can be selected in order that the toner particles acquire a charge of a positive polarity, and include materials such as sodium chloride, ammonium chloride, ammonium potassium chloride, Rochelle salt, sodium nitrate, aluminum nitrate, potassium chlorate, granular zircon, granular silicon, methylmethacrylate, glass, steel, nickel, iron ferrites, silicon dioxide and the like, with metallic carriers, especially magnetic carriers being preferred. The carriers can be used with or without a coating. The coatings generally contain polyvinylidene fluoride resins, but other resins especially those which charge negatively, such as polystyrene, halogen containing ethylenes and the like can be used. Many of the typical carriers that can be used are described in U.S. Pat. Nos. 2,618,441; 2,638,552; 3,618,552; 3,591,503; 3,533,835; and 3,526,533. Also nickel berry carriers as described in U.S. Pat. Nos. 3,847,604 and 3,767,598 can be employed, these carriers being modular carrier beads of nickel characterized by surface of reoccurring recesses and protrusions providing particles with a relatively large external area. The diameter of the coated carrier particle is from about 50 to about 1000 microns, thus allowing the carrier to possess sufficient density and inertia to avoid adherence to the electrostatic images during the development process.

The preferred single carrier material is a carrier comprised of a steel core coated with a polyvinylidene fluoride resin.

The carrier may be employed with the toner composition in any suitable combination, however, best results are obtained when about 0.5 parts to about 10 parts of toner to 100 to 200 parts by weight of carrier, and preferably about 1 part to 5 parts of toner to 100 parts by weight of carrier.

Developer compositions of the present invention may be used to develop color images on any suitable electrostatic surface capable of retaining charge including conventional photoconductors, however, the developers of the present invention are best utilized in systems wherein a negative charge resides on the photoreceptor, and this usually occurs with organic photoreceptors. Illustrative examples of organic photoreceptors include polyvinyl carbazole, 4-dimethylaminobenzylidene, benzhydrazide; 2-benzylidene-amino-carbazole, 4-dimethylamino-benzylidene, benzhydrazide; 2-benzylidene-amino-carbazole, polyvinyl carbazole; (2-nitro-benzylidene)-p-bromoaniline; 2,4-diphenylquinazoline; 1,2,4-triazine; 1,5-diphenyl-3-methyl pyrazoline 2-(4'-dimethyl-amino phenyl)-benzoxazole; 3-aminocarbazole; polyvinyl-carbazole-trinitrofluorenone charge transfer complex; phthalocyanines, layered photoreceptors, and mixtures thereof.

Numerous methods can be used to produce the toner and developer of the present invention, one method involving melt blending the resin, the colorant such as cyan pigment, and the alkyl pyridinium compound, followed by mechanical attrition, and addition of the carrier material. Other methods for toner preparation include those well known in the art such as spray drying, melt dispersion, and dispersion polymerization. For example, a solvent dispersion of the resin pigment, and alkyl pyridinium compound are spray dried under control conditions, thereby resulting in the desired product. Such a toner prepared in this manner, results in a positively charged toner in relationship to the carrier material used. Also the cyan, magenta and yellow materials can be combined by any suitable method, including for example simple known mixing and stirring methods. One method for combining these materials involves the use of a twin shell mixing blending apparatus.

Any suitable method of charging the photoreceptor may be employed when using the developers of the present invention for developing color images. Typical charging methods include for example, corona, charge deposition resulting from air breakdown and gap, commonly referred to as TESI, or charging in a vacuum with an electron gun. Typical methods of exposure include reflex, contact, holographic techniques, lens slit scanning systems, and optical projecting systems involving lens imaging of opaque reflective subjects as well as transparent film originals. Some typical development systems that can be used with the method of the present invention include cascade development, magnetic brush development and the like. Some typical fusing methods employed with the developers of the present invention include heat pressure fusing, combination of radiant and heat fusing, conductive and convection fusing, such as oven fusing, cold pressure fixing, solvent fusing, and a combination of heat pressure solvent fusing.

The above mentioned developers were found to perform exceptionally well when utilized for the production of colored xerographic prints from a colored original. There was no degradation of the triboelectric properties of the developer, nor any unacceptable imaging due to impaction, and other problems associated with prior art developers. In one embodiment the developer of the present invention is provided from a developer housing in an automatic color electrophotographic imaging fixture. The organic photoconductive member of the fixture is then charged, selectively exposed to light of the primary colors, or one of the primary colors, developed with the developer of the present invention, transferred to a suitable substrate such as paper, and then fused. In one embodiment the organic photoreceptor is exposed to a primary color (red, blue, or yellow) light source followed by development, wherein the toner used contains as the colorant a cyan pigment; followed by exposure to another different primary color, wherein the toner used contains as the colorant a magenta pigment; followed by a third exposure to another different primary color, wherein the toner used contains as the colorant a yellow pigment.

The invention will now be described in detail with respect to the specific preferred embodiments thereof, it being understood that those examples are intended to be illustrative only, and the invention is not limited to the materials, conditions, process parameters recited herein. All parts and percentages are by weight unless otherwise indicated.

EXAMPLE I

There was prepared a toner, identified as Toner A containing 5 percent of the yellow pigment permanent yellow FGL, Color Index pigment yellow 97, a commercially available material, 2 percent of cetyl pyridinium chloride, and 93 percent of a copolymer resin of styrene/n-butyl-methacrylate, percentage ratio 65/35, by melt blending followed by mechanical attrition. Three (3) parts of Toner A and 100 parts of a Hoeganaes oxidized steel carrier coated with 0.15 percent Kynar 301 F, polyvinylidene fluoride, a commercially available material (Pennwalt Corporation), were placed in a glass jar and roll milled at a linear speed of 90 feet per minute. The triboelectric charge of the developer was measured by blowing off the toner in a Faraday cage. The toner tribos as a function of time are as follows:

| Time | Toner Tribo, μc/g (Microcoulombs per gram) |
|---|---|
| 10 minutes | +52 |
| 1 hour | +48 |
| 4 hours | +51 |
| 24 hours | +47 |

EXAMPLE II

The procedure of Example I was repeated and a toner, identified as Toner B was prepared containing 5 percent of the cyan pigment copper tetra-4-(octadecylsulfonomido)phthalocyanine, 2 percent of cetyl pyridinium chloride, and 93 percent of a styrene/n-butyl methacrylate copolymer resin, percentage ratio 65/35 by melt blending, followed by mechanical attrition. Tribo measurements were accomplished using the same procedure and the same carrier, as described in Example I, with the following results:

| Time | Toner Tribo, μc/g (Microcoulombs per gram) |
|---|---|
| 10 minutes | +59 |
| 1 hour | +51 |
| 4 hours | +47 |
| 24 hours | +40 |

EXAMPLE III

Another toner, Toner C was prepared in accordance with Example I, this toner containing 5 percent of the magenta pigment, 2,9-dimethyl substituted quinacridone, 2 percent of cetyl pyridinium chloride, and 93 percent of styrene/n-butyl methacrylate, 65/35 copolymer resin. Tribo measurements were accomplished using the same procedure and the same carrier as described in Example I, with the following results:

| Time | Toner Tribo, μc/g (Microcoulombs per gram) |
|---|---|
| 10 minutes | +53 |
| 1 hour | +44 |
| 4 hours | +40 |
| 24 hours | +25 |

EXAMPLE IV

The procedure of Example I was repeated with the exception that the resin used is a copolymer of styrene/n-butyl methacrylate, percentage ratio 58/42, and substantially similar toner tribo results were obtained.

The high, stable toner tribo indicates that images of high quality and excellent resolution would result when the developer of Examples I–V (toner plus carrier) is used to develop color images.

EXAMPLE V

The developer compositions (toner and carrier) as prepared in Examples I–V were employed in a xerographic color fixture, wherein the organic photoreceptor contained in such a fixture is charged to a negative potential of −1,000 volts, and exposed to a color image through a blue filter. The latent electrostatic charge remaining on the organic photoreceptor was developed with the yellow developer of Example I, the yellow pigment being permanent yellow FGL, by engaging the developer housing into development configuration with the organic photoreceptor. The image on the organic photoreceptor was transferred to a receiver sheet in register. The organic photoreceptor was cleaned of the residual yellow toner, and the above cycle was repeated by exposing through a green filter and developing the resulting electrostatic latent image with the magenta developer of Example III, the magenta pigment being 2,9-dimethyl substituted quinacridone. This image was then transferred in register to the same receiver sheet containing the yellow separation image. The process was repeated a third time except that a red filter was used for exposure and the image developed with the cyan developer of Example II, the cyan pigment being tetra-4-(octadecylsulfonomido)phthalocyanine. The resulting image was transferred in register to a receiver sheet containing both the yellow and magenta toner images. The receiver sheet containing the cyan, magenta and yellow toner separation images in register was then heat fused to adhesively fix and fuse the image to the substrate. The above process is repeated for 75,000 cycles thereby producing 25,000 color prints of good contrast, color, and quality.

Other modifications of the present invention will occur to those skilled in the art based upon a reading of the present disclosure. These are intended to be included within the scope of this invention.

What is claimed is:

1. A colored developing composition capable of being charged positively, the composition being comprised of a resin, colored cyan, yellow, and magenta pigments selected from copper tetra-4-(octadecylsulfonomido)phthalocyanine, yellow FGL, Color Index pigment yellow 97, and 2,9-dimethyl substituted quinacridone, a single common carrier consisting of an oxidized steel core coated with polyvinylidene fluoride, and from about 0.1 percent to about 10 percent of an alkyl pyridinium compound or its corresponding hydrate of the formula:

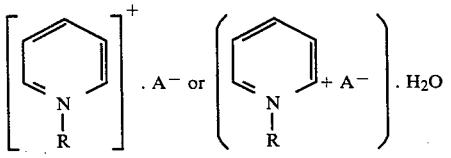

wherein R is a hydrocarbon radical containing from about 8 to about 22 carbon atoms, and A is an anion selected from halide, sulfate, sulfonate, nitrate, borate, or phosphate.

2. A developer composition in accordance with claim 1 wherein the colored pigments are present in an amount of from about 2 percent to about 20 percent.

3. A developer composition in accordance with claim 1 wherein the alkyl pyridinium compound is cetyl pyridinium chloride, and the resin is styrene/n-butyl methacrylate or polystyrene.

4. A developer composition in accordance with claim 1 wherein the alkyl pyridinium compound can be blended into the developing composition or coated on the colored pigments used in said developing composition.

5. A color electrophotographic imaging process which comprises charging a photoconductive member negatively, exposing the photoconductive member to an original to be reproduced through a filter of one color thereby selectively discharging the photoconductive member, developing the electrostatic latent image formed thereby with the positively charged developing composition of claim 1, wherein the colored pigment is 2,9-dimethyl substituted quinacridone, followed by charging the photoconductor a second time and selectively exposing the photoconductor to the same image through a filter of another primary color, developing the latent electrostatic image formed thereby with the developer composition of claim 1, wherein the colored pigment is copper tetra-4-(octadecylsulfonomido)phthalocyanine, followed by charging the photoconductive member for a third time, exposing said member to the same image through a filter of the remaining primary color, and developing the electrostatic latent image with the developer composition of claim 1, wherein the colored pigment is permanent yellow FGL, Color Index pigment yellow 97.

6. A color electrophotographic imaging process in accordance with claim 5 wherein a developer composition containing the quinacridone pigment is applied first, a developer composition containing the yellow pigment is applied second, followed by application of a developer composition containing the phthalocyanine pigment.

* * * * *